US006737152B2

(12) United States Patent
Suzuki et al.

(10) Patent No.: US 6,737,152 B2
(45) Date of Patent: May 18, 2004

(54) PROTECTIVE LAYER TRANSFER SHEET AND PRINT

(75) Inventors: Shino Suzuki, Shinjuku-ku (JP); Kenichi Hirota, Shinjuku-ku (JP)

(73) Assignee: Dai Nippon Printing Co., Ltd. (JP)

( * ) Notice: Subject to any disclaimer, the term of this patent is extended or adjusted under 35 U.S.C. 154(b) by 74 days.

(21) Appl. No.: 10/073,861

(22) Filed: Feb. 14, 2002

(65) Prior Publication Data

US 2002/0160160 A1 Oct. 31, 2002

(30) Foreign Application Priority Data

Feb. 19, 2001 (JP) ..... 2001-041073

(51) Int. Cl.[7] ..... B41M 5/40
(52) U.S. Cl. ..... 428/195.1; 503/227
(58) Field of Search ..... 428/195.1; 503/227

(56) References Cited

U.S. PATENT DOCUMENTS 6,245,382 B1 * 6/2001 Shvartsman et al. ..... 427/208.2

FOREIGN PATENT DOCUMENTS

| | | |
|---|---|---|
| EP | 0 495 482 A1 | 7/1992 |
| EP | 0 924 100 A1 | 6/1999 |
| EP | 0 982 150 A2 | 3/2000 |
| WO | WO 96/14993 | 5/1996 |
| WO | WO 01/12448 A1 | 2/2001 |

* cited by examiner

*Primary Examiner*—B. Hamilton Hess
(74) *Attorney, Agent, or Firm*—Parkhurst & Wendel, L.L.P.

(57) ABSTRACT

A protective layer transfer sheet is provided that can form by transfer a protective layer which possesses high weathering resistance and, when formed onto an image, can prevent a dye in the image from being transferred or fused to a vinyl chloride case, can prevent the dye constituting the image being faded upon exposure to light, can additionally impart good fastness to water, alcohols and the like, and thus can impart excellent fastness properties to a print. A print produced by using the protective layer transfer sheet is also provided. The protective layer transfer sheet comprises: a substrate sheet; and a thermally transferable protective layer provided on at least a part of one side of the substrate sheet, the protective layer being formed of a laminate having a multilayer structure comprising at least a layer composed mainly of an acrylic resin and a layer composed mainly of a polyester resin provided in that order on the substrate sheet.

8 Claims, No Drawings

PROTECTIVE LAYER TRANSFER SHEET AND PRINT

TECHNICAL FIELD

The present invention relates to a protective layer transfer sheet and a print, and more particularly to a protective layer transfer sheet which can impart excellent fastness properties to a print comprising an image provided on a substrate, and a print provided with an image having excellent fastness properties.

BACKGROUND ART

Printing methods, which have hitherto been extensively used for image formation, include: a sublimation dye thermal transfer method wherein a dye contained in a colorant layer is transferred by thermal sublimation and diffusion onto an image-receiving sheet; a thermal ink transfer method wherein a colorant layer is melt and softened upon heating and as such is transferred onto an image-receiving sheet; an ink jet recording method; and electrophotography.

Regarding the sublimation dye thermal transfer method among these printing methods, a method has been proposed which comprises: providing a thermal transfer sheet produced by melting or dispersing a sublimable dye as a recording material in a binder resin and supporting the melted or dispersed sublimable dye on a substrate sheet such as a polyester film to form a dye layer; putting the thermal transfer sheet on top of an object dyeable with a sublimable dye, for example, an image-receiving sheet, such as paper or a plastic film provided with a dye-receptive layer; and thermally transferring dyes by sublimation from the thermal transfer sheet onto the image-receiving sheet to form various full-color images.

In this case, a thermal head in a printer is used as heating means, and a large number of heat quantity-regulated color dots of three or four colors are transferred onto an image-receiving sheet by heating for a very short period of time to reproduce a full-color image of an original by the large number of color dots.

Images formed in this way are very clear and highly transparent, because the colorant used is a dye. Accordingly, the images have excellent reproduction of intermediate colors and gradation and have the same quality as images formed by conventional offset printing and gravure printing. Further, the above method can produce images having high quality comparable with full-color photographic images.

At the present time, a thermal transfer recording method is extensively used as a simple printing method. The thermal transfer recording method can simply form various images and thus is utilized in the preparation of prints, in which the number of times of printing may be relatively small, for example, in the preparation of ID cards and photographs for business, or in printers of personal computers or video printers.

In the sublimation dye thermal transfer method, the amount of the dye transferred can be controlled dot by dot according to the quantity of energy applied to the thermal transfer sheet. Therefore, excellent halftone images can be formed. Unlike a conventional printing ink, however, the colorant is not a pigment but a dye having a relatively low molecular weight and, in addition, does not contain any vehicle. For this reason, the formed images are disadvantageously inferior in fastness properties, such as lightfastness, weathering resistance, and abrasion resistance, to images formed using conventional printing ink.

Further, prints formed by ink jet recording are disadvantageously poor in fastness to solutions usually found in general households, such as water and alcohols, that is, fastness to water, chemicals, solvents and the like. In addition, for example, upon contact of prints, for example, with plasticizer-containing card cases, file sheets, or plastic erasers, images are blurred, or otherwise, dyes are transferred onto these contacted materials. That is, these prints disadvantageously have poor plasticizer resistance.

A method for solving the above problem is to form a protective layer by transfer onto the formed image. In this method wherein a protective layer is formed by transfer, when sublimation transfer is used, the same thermal head as used in the formation of images can be used in the formation of the protective layer. Therefore, as compared with lamination or pouching of a molding film, the protective layer can be formed by transfer by means of a simpler device at a lower cost. This method, however, is disadvantageous in that the plasticizer resistance of the prints with a protective layer formed thereon is unsatisfactory. In particular, when a print, in which a protective layer has been thermally transferred onto an image-receiving sheet with an image formed thereon, is stored in contact with a plasticizer-containing card case, file sheet, plastic eraser or other material, dyes constituting the image in the print are transferred onto the contacted material, such as cases. This disadvantageously contaminates the cases or lowers the density of the print. Further, when the print is taken out of the case in which the print is in contact with a plasticizer-containing card case, file sheet, plastic eraser or other material, the image is disadvantageously broken.

Poor plasticizer resistance of the print with a protective layer formed thereon by sublimation transfer is considered attributable to the following fact. Specifically, the contamination of the case occurs due to the formation of cracks in the protective layer through which dyes are transferred to the case side, and the breaking of the image occurs due to fusing between the protective layer and the case. When a protective layer formed of a highly flexible resin or a hydrophilic resin is adopted in consideration of these points, good plasticizer resistance could be imparted to the print. This protective layer, however, has a problem with fastness to water, alcohols and the like and, in addition, requires high energy for transfer.

Accordingly, it is an object of the present invention to solve the above problems of the prior art and to provide a protective layer transfer sheet that can form by transfer a protective layer which possesses high weathering resistance and, when formed by transfer onto an image, can prevent a dye in the image from being transferred or fused to a vinyl chloride case, can prevent the dye constituting the image being faded upon exposure to light, and thus can impart excellent fastness properties to a print.

It is another object of the present invention to provide a print having an image possessing excellent fastness properties.

DISCLOSURE OF THE INVENTION

The object of the present invention can be attained by a protective layer transfer sheet comprising: a substrate sheet; and a thermally transferable protective layer provided on at least a part of one side of the substrate sheet, said protective layer being formed of a laminate having a multilayer structure comprising at least a layer composed mainly of an acrylic resin and a layer composed mainly of a polyester resin provided in that order on the substrate sheet.

The acrylic resin is preferably an acrylic copolymer composed mainly of polymethyl methacrylate.

Preferably, the polyester resin comprises an alicyclic compound contained in at least one of a diol component and an acid component, and/or has, in one molecular chain, one or more aromatic dicarboxylic acids containing a sulfonic acid substituent or a group of a salt thereof.

The alicyclic compound in the polyester resin is preferably tricyclodecanemethanol, cyclohexanedicarboxylic acid, cyclohexanedimethanol, or cyclohexanediol.

The protective layer transfer sheet may further comprise a release layer between the protective layer and the substrate sheet.

The protective layer transfer sheet may further comprise an adhesive layer stacked on the protective layer.

The layer composed mainly of the polyester resin and/or the adhesive layer may contain an ultraviolet absorber.

In the protective layer transfer sheet, an organic filler and/or an inorganic filler may be contained in an outermost surface layer provided on the substrate sheet in its side remote from the protective layer.

According to another aspect of the present invention, there is provided a print comprising: a substrate sheet; at least a dye-colored image provided on at least one side of the substrate sheet; and a protective layer provided so as to cover at least a part of the printed face in the print, said protective layer having been formed by transfer using any one of the above protective layer transfer sheets.

According to the present invention, the protective layer transfer sheet comprises: a substrate sheet; and a thermally transferable protective layer provided on at least a part of one side of the substrate sheet, the protective layer being formed of a laminate having a multilayer structure comprising at least a layer composed mainly of an acrylic resin and a layer composed mainly of a polyester resin provided in that order on the substrate sheet. When a protective layer has been transferred from the protective layer transfer sheet having the above construction onto an image, the transferred protective layer can prevent the dye from being transferred or fused onto vinyl chloride cases or the like and can prevent a dye constituting the image from being faded upon exposure to light. Further, even when an alcohol or water is spilled on prints, no trace is left, that is, the transferred protective layer can impart excellent fastness properties to prints.

BEST MODE FOR CARRYING OUT THE INVENTION

Preferred embodiments of the present invention will be explained.

(Substrate Sheet)

In the protective layer transfer sheet of the present invention, any substrate sheet used in conventional thermal transfer sheets may be used as the substrate sheet. Specific examples of preferred substrate sheets include: tissue papers, such as capacitor paper, glassine paper, and paraffin paper; stretched or unstretched films or sheets of various plastics, for example, highly heat-resistant polyesters, such as polyethylene terephthalate, polybutylene terephthalate, polyphenylene sulfide, polyether ketone, polyether sulfone, and polyethylene naphthalate, polypropylene, polycarbonate, cellulose acetate, polyethylene derivatives, polyvinyl chloride, polyvinylidene chloride, polystyrene, polyamide, polyimide, polymethylpentene, and ionomers; easy adhesion-imparting surface treatment products of the above materials; and laminates of the above materials.

The thickness of the substrate sheet may be properly varied depending upon materials for the substrate sheet so that the substrate sheet has proper strength and heat resistance. In general, however, the thickness is preferably about 1 to 100 $\mu$m.

(Protective Layer)

The protective layer according to the present invention is formed of a laminate having a multilayer structure comprising at least a layer composed mainly of an acrylic resin and a layer composed mainly of a polyester resin provided in that order on the substrate sheet.

In the present invention, the term "laminate" includes such a state that the above layers have been successively put on top of each other or one another by coating.

According to the present invention, the acrylic resin is a polymer comprising at least one monomer selected from the group consisting of conventional acrylate monomers and methacrylate monomers. In addition to the acrylic monomer, for example, styrene or acrylonitrile may be used as a comonomer. The monomer is preferably methyl methacrylate, and the monomer component preferably contains methyl methacrylate in an amount of not less than 50% by weight in terms of charge weight ratio.

Conventional acrylic monomers usable herein include:

methyl acrylate, methyl methacrylate, ethyl acrylate, ethyl methacrylate, propyl acrylate, propyl methacrylate, butyl acrylate, butyl methacrylate, isobutyl acrylate, isobutyl methacrylate, tert-butyl acrylate, tert-butyl methacrylate, isodecyl acrylate, isodecyl methacrylate, lauryl acrylate, lauryl methacrylate, lauryltridecyl acrylate, lauryltridecyl methacrylate, tridecyl acrylate, tridecyl methacrylate, cetylstearyl acrylate, cetylstearyl methacrylate, stearyl acrylate, stearyl methacrylate, 2-ethylhexyl acrylate, 2-ethylhexyl methacrylate, octyl acrylate, octyl methacrylate, cyclohexyl acrylate, cyclohexyl methacrylate, benzyl acrylate, benzyl methacrylate, phenoxyethyl acrylate, phenoxyethyl methacrylate, isobornyl acrylate, isobornyl methacrylate, dicyclopentenyl acrylate, dicyclopentenyl methacrylate, methacrylic acid, 2-hydroxyethyl acrylate, 2-hydroxyethyl methacrylate, 2-hydroxypropyl acrylate, 2-hydroxypropyl methacrylate, dimethylaminoethyl acrylate, dimethylaminoethyl methacrylate, diethylaminoethyl acrylate, diethylaminoethyl methacrylate, tert-butylaminoethyl acrylate, tert-butylaminoethyl methacrylate, glycidyl acrylate, glycidyl methacrylate, tetrahydrofurfuryl acrylate, and tetrahydrofurfuryl methacrylate; and ethylene diacrylate, ethylene dimethacrylate, diethylene glycol diacrylate, diethylene glycol dimethacrylate, triethylene glycol diacrylate, triethylene glycol dimethacrylate, tetraethylene glycol diacrylate, tetraethylene glycol dimethacrylate, decaethylene glycol diacrylate, decaethylene glycol dimethacrylate, pentadecaethylene glycol diacrylate, pentadecaethylene glycol dimethacrylate, pentacontahectaethylene glycol diacrylate, pentacontahectaethylene glycol dimethacrylate, butylene diacrylate, butylene dimethacrylate, allyl acrylate, allyl methacrylate, trimethylolpropane triacrylate, trimethylolpropane trimethacrylate, 1,6-hexanediol diacrylate, 1,6-hexanediol dimethacrylate, tripropylene glycol diacrylate, tripropylene glycol dimethacrylate, pentaerythritol tetraacrylate, pentaerythritol tetramethacrylate, dipentaerythritol hexaacrylate, dipentaerythritol hexamethacrylate, neopentyl glycol pentaacrylate, neopentylglycol pentamethacrylate, phosphazene hexaacrylate, and phosphazene hexamethacrylate.

The acrylic resin according to the present invention preferably has a molecular weight of not less than 20,000 and not more than 100,000. When the molecular weight is less than 20,000, an oligomer is produced during the synthesis of the resin and, consequently, stable properties cannot be obtained. On the other hand, when the molecular weight exceeds 100,000, the transferability of a protective layer from the protective layer transfer sheet is deteriorated.

According to the present invention, the polyester resin may be any conventional saturated polyester resin. Acid components in the polyester resin used in the present invention include aromatic compounds, aliphatic dicarboxylic acids, and alicyclic dicarboxylic acids. Examples of aromatic compounds include terephthalic acid, isophthalic acid, o-phthalic acid, 2,6-naphthalenedicarboxylic acid, tetrahydrophthalic acid, hexahydrophthalic acid, hexahydroisophthalic acid, and hexahydroterephthalic acid. Examples of aliphatic dicarboxylic acids include succinic acid, adipic acid, azelaic acid, sebacic acid, dodecanedionic acid, and dimeric acid. Examples of alicyclic dicarboxylic acids include cyclohexanedicarboxylic acid, tricyclodecanedicarboxylic acid, and decalindicarboxylic acid. These compounds may be in the form of methyl ester thereof or acid anhydride thereof.

The above compound may be if necessary used in combination with p-(hydroxyethoxy)benzoic acid, hydroxypivalic acid, γ-butyrolactone, ϵ-caprolactone, fumaric acid, maleic acid, maleic anhydride, itaconic acid, citraconic acid or the like. Further, if necessary, tri- or higher functional polycarboxylic acids, for example, tri- and tetracarboxylic acids, such as trimellitic acid and pyromellitic acid, may be used so far as the amount of the tri- or higher functional polycarboxylic acid used is not more than 10% by mole based on the whole carboxylic acid component. In particular, the presence of one or more acid components, in which a part of the aromatic dicarboxylic acid has been substituted by sulfonic acid or a salt thereof, in one molecular chain is preferred. More preferably, the degree of substitution by sulfonic acid or a group of a salt thereof falls within such a range that the copolymer is soluble in an organic solvent, because the copolymer can be used as a mixture thereof with other organic solvent-soluble additives or resins.

Preferred aromatic dicarboxylic acids containing a sulfonic acid substituent or a group of a salt thereof include: sulfoterephthalic acid, 5-sulfoisophthalic acid, 4-sulfophthalic acid, 4-sulfonaphthalene-2,7-dicarboxylic acid, and 5-(4-sulfophenoxy)isophthalic acid; ammonium salts of these compounds; and lithium, potassium, magnesium, calcium, copper, iron or other metal salts of these compounds. 5-Sodium sulfoisophthalate is particularly preferred.

Polyol components as other starting material of the polyester used in the present invention include ethylene glycol, 1,2-propylene glycol, 1,3-propanediol, 1,4-butanediol, neopentyl glycol, 1,5-pentanediol, 1,6-hexanediol, 3-methyl-1,5-pentanediol, 1,9-nonanediol, 2-ethyl-2-butylpropanediol, hydroxypivalic acid neopentyl glycol ester, dimethylolheptane, 2,2,4-trimethyl-1,3-pentanediol. If necessary, diethylene glycol, triethylene glycol, dipropylene glycol, and, in addition, polyethylene glycol, polypropylene glycol, polytetramethylene glycol, neopentyl glycol ethylene oxide adduct, and neopentyl glycol propylene oxide adduct may also be used.

Examples of aromatic-containing glycols include: p-xylene glycol; m-xylene glycol; o-xylene glycol; 1,4-phenylene glycol; an ethylene oxide adduct of 1,4-phenylene glycol; bisphenol A; and glycols produced by adding one or several mol of ethylene oxide or propylene oxide to two phenolic hydroxyl groups in bisphenols, for example, an ethylene oxide adduct or propylene oxide adduct of bisphenol A. Examples of alicyclic diol components include tricyclodecanediol, tricyclodecanedimethylol, tricyclodecanedimethanol (TCD-M), cyclohexanediol, 1,4-cyclohexanedimethanol, hydrogenated bisphenol A, and ethylene oxide and propylene oxide adducts of hydrogenated bisphenol A.

For the polyester resin, the glass transition temperature is preferably 50 to 120° C., and the molecular weight is preferably in the range of 2,000 to 40,000, more preferably in the range of 4,000 to 20,000, from the viewpoint of good transferability of a protective layer from the protective layer transfer sheet.

In the protective layer transfer sheet according to the present invention, the layer composed mainly of a polyester resin in the protective layer and/or an adhesive layer may contain an ultraviolet absorber. Conventional inorganic ultraviolet absorbers and organic ultraviolet absorbers may be used as the ultraviolet absorber. Organic ultraviolet absorbers usable herein include: salicylate, benzophenone, benzotriazole, triazine, substituted acrylonitrile, nickel chelate, hindered amine, and other nonreactive organic ultraviolet absorbers; and compounds produced by introducing, for example, an additon-polymerizable double bond, such as a vinyl or acryloyl group or a methacryloyl group, or an alcoholic hydroxyl, amino, carboxyl, epoxy, isocyanate or other group, into the nonreactive ultraviolet absorber and then copolymerizing the treated nonreactive ultraviolet absorber with a thermoplastic resin, such as an acrylic resin, or grafting the treated nonreactive ultraviolet absorber onto the thermoplastic resin. Among these ultraviolet absorbers, benzophenone, benzotriazole, and triazine ultraviolet absorbers are particularly preferred. From the viewpoint of covering effective ultraviolet absorption wavelength region according to the properties of dyes used in image formation, preferably, a combination of ultraviolet absorbers different from each other in system is used, and, in the case of nonreactive ultraviolet absorbers, the use of a mixture of a plurality of nonreactive ultraviolet absorbers different from each other in structure is preferred from the viewpoint of avoiding the precipitation of the ultraviolet absorber.

Release Layer

In the protective layer transfer sheet according to the present invention, when the protective layer is less likely to separate from the substrate sheet at the time of thermal transfer, a release layer may be formed between the substrate sheet and the protective layer. In other words, the substrate sheet may be subjected to release treatment by providing a release layer on the substrate sheet. The release layer may be formed by coating a coating liquid containing at least one member selected from the group consisting of, for example, waxes, silicone wax, silicone resin, fluororesin, acrylic resin, polyvinyl alcohol resin, cellulosic derivative resin, urethane resin, vinyl acetate resin or resin analogous thereto, acryl vinyl ether resin, maleic anhydride resin, and copolymers comprising monomers constituting the above resins by a conventional method, such as gravure coating or gravure reverse coating, and drying the coating.

Among these resins, a resin produced by polymerization of a single monomer, such as acrylic acid or methacrylic acid, or by copolymerization of a monomer, such as acrylic acid or methacrylic acid, with other monomer or the like is preferred as the acrylic resin which is excellent in adhesion to the substrate sheet, as well as in releasability from the protective layer.

The release layer may be properly selected from a type which is transferred onto an object upon thermal transfer, a type which is left on the substrate sheet side upon thermal transfer, a type which is subjected to cohesive failure and the like. From the viewpoints of excellent surface gloss, transfer stability of the protective layer and the like, however, the type is preferably such that the release layer is non-transferable and, upon thermal transfer, remains on the substrate sheet side so that the interface between the release layer and the thermally transferable protective layer serves as the surface of the protective layer after the thermal transfer.

The release layer may be formed by a conventional coating method, and a release layer thickness of about 0.5 to 5 $\mu$m on a dry basis suffices for the contemplated results. When a protective layer, which becomes matte upon transfer, is desired, the incorporation of various particles in the release layer or matting treatment of the surface of the release layer on the protective layer side can provide a protective layer having a matte surface.

It should be noted that, when the releasability of the protective layer from the substrate sheet is good, there is no need to provide the release layer. In this case, upon thermal transfer, the protective layer can be released directly from the substrate sheet.

(Adhesive Layer)

According to the present invention, an adhesive layer is preferably provided on the outermost surface of the protective layer, which is a laminate having a multilayer structure, in the protective layer transfer sheet from the viewpoint of improving the adhesion of the protective layer to a print. The adhesive layer may be formed of any conventional pressure-sensitive adhesive or heat-sensitive adhesive, more preferably a thermoplastic resin having a glass transition temperature of 50 to 80° C. For example, it is preferred to select a resin having a suitable glass transition temperature from resins having good adhesion in a hot state, for example, from ultraviolet absorbing resins, acrylic resins, vinyl chloride-vinyl acetate copolymer resins, epoxy resins, polyester resins, polycarbonate resins, butyral resins, polyamide resins, and vinyl chloride resins.

The ultraviolet absorbing resin may be, for example, a resin produced by bonding, through a reaction, a reactive ultraviolet absorbing agent to a thermoplastic resin or an ionizing radiation-curable resin. A more specific example thereof is one produced by introducing a reactive group, such as an addition-polymerizable double bond (for example, a vinyl, acryloyl, or methacryloyl group) or an alcoholic hydroxyl, amino, carboxyl, epoxy, or isocyanate group into a conventional nonreactive organic ultraviolet absorber, for example, a salicylate, benzophenone, benzotriazole, substituted acrylonitrile, nickel chelate, or hindered amine nonreactive ultraviolet absorber.

The adhesive layer may be formed of the above resin and optional additives, for example, organic ultraviolet absorbers, such as benzophenone compounds, benzotriazole compounds, oxalic anilide compounds, cyanoacrylate compounds, and salicylate compounds, or inorganic fine particles having ultraviolet absorption capacity, such as oxides of zinc, titanium, cerium, tin, iron or the like. Further, if necessary, color pigments, white pigments, extender pigments, fillers, antistatic agents, antioxidants, brightening agents and the like may also be properly used as additives.

An adhesive layer preferably having a thickness of about 0.5 to 10 $\mu$m on a dry basis is formed by coating a coating liquid containing the above resin for constituting the adhesive layer and optionally the above additives and then drying the coating.

(Backside Layer)

In the protective layer transfer sheet according to the present invention, a backside layer may be provided on the backside of the substrate sheet, that is, on the substrate sheet in its side remote from the thermally transferable protective layer, from the viewpoint of avoiding adverse effects, such as sticking or cockling caused by heat from the thermal head.

Any conventional resin may be used as the resin for the formation of the backside layer, and examples thereof include polyvinylbutyral resins, polyvinylacetoacetal resins, polyester resins, vinyl chloride-vinyl acetate copolymers, polyether resins, polybutadiene resins, styrene-butadiene copolymers, acrylic polyols, polyurethane acrylates, polyester acrylates, polyether acrylates, epoxy acrylates, urethane or epoxy prepolymers, nitrocellulose resins, cellulose nitrate resins, cellulose acetopropionate resins, cellulose acetate butyrate resins, cellulose acetate hydrogenphthalate resins, cellulose acetate resins, aromatic polyamide resins, polyimide resins, polycarbonate resins, and chlorinated polyolefin resins.

A cured product produced by reacting a thermoplastic resin having therein a reaction group with a polyisocyanate, or a reaction product of the resin with an unsaturated bond-containing monomer or oligomer may be used from the viewpoint of improving the heat resistance and coating strength of the backside layer and the adhesion of the backside layer to the substrate sheet. Curing methods are not particularly limited and include heating and application of an ionizing radiation.

Slip property-imparting agents added to or coated onto the backside layer formed of the above resin include phosphoric esters, silicone oils, graphite powders, silicone graft polymers, fluoro graft polymers, acrylic silicone graft polymers, acrylsiloxanes, arylsiloxanes, and other silicone polymers. Preferably, the backside layer is formed of a polyol, for example, a polyalcohol polymer compound, a polyisocyanate compound, or a phosphoric ester compound. Further, the addition of a filler is more preferred.

The use of an inorganic or organic filler is preferred as the filler from the viewpoints of fabricability of the transfer sheet, stabilization of travel of prints, and impartation of a thermal head cleaning property. The filler is selected from those which have satisfactory particle diameter and shape for forming concaves and convexes on the surface of the backside layer and cause no significant abrasion of thermal head. Examples of fillers usable herein include: inorganic fillers, such as talc, kaolin, clay, calcium carbonate, magnesium hydroxide, magnesium carbonate, magnesium oxide, precipitated barium sulfate, hydrotalcite silica, and molybdenum disulfide; and organic fillers, such as acrylic crosslinked resins, melamine crosslinked resins, benzoguanamine resins, molybdenum disulfide, silicones, and teflon. Preferred are talc, kaolin, clay and the like that are cleavable, have relatively low hardness and have a suitable level of thermal head cleaning property. More specifically, in the case of talc, the shot-type abrasion degree is preferably 15 to 200 mg. When the abrasion degree is excessively low, refuse is likely to occur in head. On the other hand, when the abrasion degree is excessively high, the abrasion of a protective layer in the thermal head is significant.

The average particle diameter of the filler is 0.01 to 10 $\mu$m, preferably about 0.1 to 5 $\mu$m. The incorporation of the filler can roughen the surface of coating and can reduce the number of points of contact with the thermal head to reduce the coefficient of friction and to impart slipperiness. Further, roughening of the surface of coating can improve fabricability, for example, can reduce cockling at the time of winding.

The backside layer may be formed by dissolving or dispersing the above resin, slip property-imparting agent, and filler in a suitable solvent to prepare an ink for a backside layer, coating the ink onto the backside of the substrate sheet, for example, by gravure printing, screen printing, or reverse coating using a gravure plate, and drying the coating. The thickness of the backside layer is about 0.1 to 2 $\mu$m on a solid basis.

EXAMPLES

The present invention will be described in more detail with reference to the following examples and comparative examples. In the following examples and comparative examples, "parts" or "%" is by weight unless otherwise specified.

(Preparation of Thermal Transfer Image-receiving Sheets)

Thermal transfer image-receiving sheets were prepared as follows.

A 150 $\mu$m-thick synthetic paper (YUPO FPG #150, manufactured by Oji-Yuka Synthetic Paper Co., Ltd.) was provided as a substrate sheet. A coating liquid 1 for a receptive layer having the following composition was coated (coverage: 5.0 g/m$^2$ on solid basis) onto one side of the substrate sheet by wire bar coating, and the coating was then dried at 110° C. for 30 sec to prepare a thermal transfer image-receiving sheet (image-receiving paper 1). The above procedure was repeated, except that a coating liquid 2 for a receptive layer was coated. Thus, an image-receiving paper 2 was prepared.

| | |
|---|---|
| (Coating liquid 1 for receptive layer) | |
| Vinyl chloride-vinyl acetate copolymer (Denka Vinyl #1000A, manufactured by Denki Kagaku Kogyo K.K.) | 100 parts |
| Epoxy-modified silicone (X-22-3000T, manufactured by The Shin-Etsu Chemical Co., Ltd.) | 10 parts |
| Methyl ethyl ketone/toluene (weight ratio = 1/1) | 400 parts |
| (Coating liquid 2 for receptive layer) | |
| Cellulose acetate butyrate (CAB 381-0.1, manufactured by Eastman Chemical Products, Inc.) | 85 parts |
| Polycaprolactone (Placcel H5, manufactured by Daicel Chemical Industries, Ltd.) | 15 parts |
| Polyether-modified silicone (FZ-2222, manufactured by Nippon Unicar Co., Ltd.) | 1 part |
| Methyl ethyl ketone/toluene (weight ratio = 1/1) | 400 parts |

(Preparation of Protective Layer Transfer Sheets)

100 mol of an acid component and 100 mol of an alcohol component indicated in Table 1 below and 0.5 mol, based on 100 mol of the alcohol component, of tetrabutoxytitanate as a catalyst were charged into an autoclave equipped with a thermometer and a stirrer. The contents of the autoclave were heated at 150 to 220° C. for 3 hr to conduct transesterification. Next, the temperature of the reaction system was raised to 250° C. for 30 min, and the pressure of the system was gradually reduced so that, 45 min after the initiation of the reduction of the pressure, the pressure reached not more than 0.3 mmHg. Under this condition, a reaction was continued for additional 90 min to prepare polyesters 1 to 4 for use in a protective layer.

TABLE 1

| | Components | Amount | Molecular weight |
|---|---|---|---|
| Polyester resin-1 | Ethylene glycol | 50 mol | 18000 |
| | Neopentyl glycol | 50 mol | |
| | Terephthalic acid | 50 mol | |
| | Isophthalic acid | 50 mol | |
| Polyester resin-2 | Ethylene glycol | 50 mol | 18000 |
| | Neopentyl glycol | 50 mol | |
| | Terephthalic acid | 49 mol | |
| | Isophthalic acid | 49.5 mol | |
| | 5-Sodium sulfoisophthanate | 1.5 mol | |
| Polyester resin-3 | Ethylene glycol | 50 mol | 10000 |
| | Neopentyl glycol | 50 mol | |
| | Terephthalic acid | 48 mol | |
| | Isophthalic acid | 49 mol | |
| | 5-Sodium sulfoisophthanate | 3 mol | |
| Polyester resin-4 | Ethylene glycol | 10 mol | 5000 |
| | TCD-M | 90 mol | |
| | Terephthalic acid | 50 mol | |
| | Isophthalic acid | 50 mol | |

(Composition of Coating Liquid for Protective Layer)

Coating liquids for a protective layer transfer sheet were then prepared according to the following formulations.

| | |
|---|---|
| (Coating liquid 1 for protective layer A (A-1)) | |
| Acrylic resin (BR 87, manufactured by Mitsubishi Rayon Co., Ltd.) | 20 parts |
| Methyl ethyl ketone/toluene (weight ratio = 8/2) | 80 parts |
| (Coating liquid 2 for protective layer A (A-2)) | |
| Acrylic resin (BR 75, manufactured by Mitsubishi Rayon Co., Ltd.) | 20 parts |
| Methyl ethyl ketone/toluene (weight ratio = 8/2) | 80 parts |
| (Coating liquid 3 for protective layer A (A-3)) | |
| Urethane emulsion | 20 parts |
| PVA | 10 parts |
| Distilled water | 85 parts |
| (Coating liquid 1 for protective layer B (B-1)) | |
| Polyester resin-1 (Table 1) | 20 parts |
| Methyl ethyl ketone/toluene (weight ratio = 1/1) | 80 parts |
| (Coating liquid 2 for protective layer B (B-2)) | |
| Polyester resin-2 (Table 1) | 20 parts |
| Methyl ethyl ketone/toluene (weight ratio = 1/1) | 80 parts |
| (Coating liquid 3 for protective layer B (B-3)) | |
| Polyester resin-3 (Table 1) | 20 parts |
| Methyl ethyl ketone/toluene (weight ratio = 1/1) | 80 parts |
| (Coating liquid 4 for protective layer B (B-4)) | |
| Polyester resin-4 (Table 1) | 20 parts |
| Methyl ethyl ketone/toluene (weight ratio = 1/1) | 80 parts |
| (Coating liquid 5 for protective layer B (B-5)) | |
| Polyester resin-3 (Table 1) | 20 parts |
| Ultraviolet absorber 1 (Tinuvin 320 (benzotriazole ultraviolet absorber), manufactured by Ciba-Geigy) | 2 parts |
| Ultraviolet absorber 2 (Tinuvin 900 (benzotriazole ultraviolet absorber), | 2 parts |

-continued

| | |
|---|---|
| manufactured by Ciba-Geigy) | |
| Finely divided silica (Sylysia 310 P, manufactured by Fuji Sylysia Chemical Ltd.) | 0.6 part |
| Methyl ethyl ketone/toluene (weight ratio = 1/1) | 80 parts |

(Coating liquid 6 for protective layer B (B-6))

| | |
|---|---|
| Polyester resin-4 (Table 1) | 20 parts |
| Ultraviolet absorber 1 (Tinuvin 320 (benzotriazole ultraviolet absorber), manufactured by Ciba-Geigy) | 2 parts |
| Ultraviolet absorber 2 (Tinuvin 900 (benzotriazole ultraviolet absorber), manufactured by Ciba-Geigy) | 2 parts |
| Finely divided silica (Sylysia 310 P, manufactured by Fuji Sylysia Chemical Ltd.) | 0.6 part |
| Methyl ethyl ketone/toluene (weight ratio = 1/1) | 80 parts |

(Coating liquid 7 for protective layer B (B-7))

| | |
|---|---|
| Polyester resin-4 (Table 1) | 10 parts |
| Acrylic resin (BR 87, manufactured by Mitsubishi Rayon Co., Ltd.) | 10 parts |
| Ultraviolet absorber 1 (Tinuvin 320 (benzotriazole ultraviolet absorber), manufactured by Ciba-Geigy) | 2 parts |
| Ultraviolet absorber 2 (Tinuvin 900 (benzotriazole ultraviolet absorber), manufactured by Ciba-Geigy) | 2 parts |
| Finely divided silica (Sylysia 310 P, manufactured by Fuji Sylysia Chemical Ltd.) | 0.6 part |
| Methyl ethyl ketone/toluene (weight ratio = 1/1) | 80 parts |

(Coating liquid 8 for protective layer B (B-8))

| | |
|---|---|
| Polyester resin-4 (Table 1) | 15 parts |
| Acrylic resin (BR 87, manufactured by Mitsubishi Rayon Co., Ltd.) | 5 parts |
| Ultraviolet absorber 1 (Tinuvin 320 (benzotriazole ultraviolet absorber), manufactured by Ciba-Geigy) | 2 parts |
| Ultraviolet absorber 2 (Tinuvin 900 (benzotriazole ultraviolet absorber), manufactured by Ciba-Geigy) | 2 parts |
| Finely divided silica (Sylysia 310 P, manufactured by Fuji Sylysia Chemical Ltd.) | 0.6 part |
| Methyl ethyl ketone/toluene (weight ratio = 1/1) | 80 parts |

(Coating liquid 9 for protective layer B (B-9))

| | |
|---|---|
| Polyester resin-4 (Table 1) | 10 parts |
| Acrylic resin (BR 87, manufactured by Mitsubishi Rayon Co., Ltd.) | 6 parts |
| Ultraviolet absorber-acryl copolymer (UVA 635 L (benzophenone ultraviolet absorber), manufactured by BASF Japan Ltd.) | 4 parts |
| Ultraviolet absorber 1 (Tinuvin 320 (benzotriazole ultraviolet absorber), manufactured by Ciba-Geigy) | 2 parts |
| Ultraviolet absorber 2 (Tinuvin 900 (benzotriazole ultraviolet absorber), manufactured by Ciba-Geigy) | 2 parts |
| Finely divided silica (Sylysia 310 P, manufactured by Fuji Sylysia Chemical Ltd.) | 0.6 part |
| Methyl ethyl ketone/toluene (weight ratio = 1/1) | 80 parts |

(Coating liquid 10 for protective layer B (B-10))

| | |
|---|---|
| Acrylic resin (BR 87, manufactured by Mitsubishi Rayon Co., Ltd.) | 20 parts |
| Ultraviolet absorber 1 (Tinuvin 320 (benzotriazole ultraviolet absorber), manufactured by Ciba-Geigy) | 2 parts |
| Ultraviolet absorber 2 (Tinuvin 900 (benzotriazole ultraviolet absorber), manufactured by Ciba-Geigy) | 2 parts |
| Finely divided silica (Sylysia 310 P, manufactured by Fuji Sylysia Chemical Ltd.) | 0.6 part |
| Methyl ethyl ketone/toluene (weight ratio = 1/1) | 80 parts |

(Coating liquid 11 for protective layer B (B-11))

| | |
|---|---|
| Polyester resin-4 (Table 1) | 5 parts |
| Acrylic resin (BR 87, manufactured by Mitsubishi Rayon Co., Ltd.) | 15 parts |
| Ultraviolet absorber 1 (Tinuvin 320 (benzotriazole ultraviolet absorber), manufactured by Ciba-Geigy) | 2 parts |
| Ultraviolet absorber 2 (Tinuvin 900 (benzotriazole ultraviolet absorber), manufactured by Ciba-Geigy) | 2 parts |
| Finely divided silica (Sylysia 310 P, manufactured by Fuji Sylysia Chemical Ltd.) | 0.6 part |
| Methyl ethyl ketone/toluene (weight ratio = 1/1) | 80 parts |

(Coating liquid 12 for protective layer B (B-12))

| | |
|---|---|
| Polyester resin-4 (Table 1) | 10 parts |
| Acrylic resin (BR 87, manufactured by Mitsubishi Rayon Co., Ltd.) | 10 parts |
| Ultraviolet absorber 1 (Tinuvin 320 (benzotriazole ultraviolet absorber), manufactured by Ciba-Geigy) | 1 part |
| Ultraviolet absorber 2 (Tinuvin 900 (benzotriazole ultraviolet absorber), manufactured by Ciba-Geigy) | 1 part |
| Ultraviolet absorber 3 (Tinuvin 120 (benzophenone ultraviolet absorber), manufactured by Ciba-Geigy) | 1 part |
| Finely divided silica (Sylysia 310 P, manufactured by Fuji Sylysia Chemical Ltd.) | 0.6 part |
| Methyl ethyl ketone/toluene (weight ratio = 1/1) | 80 parts |

(Coating liquid 13 for protective layer B(B-13))

| | |
|---|---|
| Polyester resin-4 (Table 1) | 10 parts |
| Acrylic resin (BR 87, manufactured by Mitsubishi Rayon Co., Ltd.) | 6 parts |
| Ultraviolet absorber-acryl copolymer (UVA 635 L (benzophenone ultraviolet absorber), manufactured by BASF Japan Ltd.) | 4 parts |
| Ultraviolet absorber 1 (Tinuvin 320 (benzotriazole ultraviolet absorber), manufactured by Ciba-Geigy) | 1 part |
| Ultraviolet absorber 2 (Tinuvin 900 (benzotriazole ultraviolet absorber), manufactured by Ciba-Geigy) | 1 part |
| Ultraviolet absorber 3 (Tinuvin 120 (benzophenone ultraviolet absorber), manufactured by Ciba-Geigy) | 1 part |
| Finely divided silica (Sylysia 310 P, manufactured by Fuji Sylysia Chemical Ltd.) | 0.6 part |
| Methyl ethyl ketone/toluene (weight ratio = 1/1) | 80 parts |

(Procedure for Preparing Protective Layer Transfer Sheet)

Example 1

A 6 μm-thick polyethylene terephthalate film (manufactured by Toray Industries, Inc.) was provided as a substrate sheet. This substrate sheet had a backside layer on its backside, and the other side had been subjected to releasability-imparting treatment. The coating liquid for a protective layer A-1 was coated at a coverage of 0.5 μm on a dry basis onto the releasability-imparted side of the substrate sheet, and the coating was dried at 110° C. for one min to form a protective layer A-1. The coating liquid for a protective layer B-1 was coated at a coverage of 1 μm on a dry basis onto the protective layer A-1, and the coating was dried at 110° C. for one min to form a protective layer B-1. Thus, a protective layer transfer sheet of the present invention was prepared.

Example 2

A protective layer transfer sheet of the present invention was prepared in the same manner as in Example 1, except that the coating liquid for a protective layer A-2 and the coating liquid for a protective layer B-2 were used respectively instead of the coating liquid for a protective layer A-1 and the coating liquid for a protective layer B-1.

Example 3

A protective layer transfer sheet of the present invention was prepared in the same manner as in Example 1, except that the coating liquid for a protective layer B-3 was used instead of the coating liquid for a protective layer B-1.

Example 4

A protective layer transfer sheet of the present invention was prepared in the same manner as in Example 1, except that the coating liquid for a protective layer A-2 and the coating liquid for a protective layer B-4 were used respectively instead of the coating liquid for a protective layer A-1 and the coating liquid for a protective layer B-1.

Example 5

A protective layer transfer sheet of the present invention was prepared in the same manner as in Example 1, except that the coating liquid for a protective layer A-2 and the coating liquid for a protective layer B-5 were used respectively instead of the coating liquid for a protective layer A-1 and the coating liquid for a protective layer B-1.

Example 6

A protective layer transfer sheet of the present invention was prepared in the same manner as in Example 1, except that the coating liquid for a protective layer B-6 was used instead of the coating liquid for a protective layer B-1.

Example 7

A protective layer transfer sheet of the present invention was prepared in the same manner as in Example 1, except that the coating liquid for a protective layer B-7 was used instead of the coating liquid for a protective layer B-1.

Example 8

A protective layer transfer sheet of the present invention was prepared in the same manner as in Example 1, except that the coating liquid for a protective layer B-8 was used instead of the coating liquid for a protective layer B-1.

Example 9

A protective layer transfer sheet of the present invention was prepared in the same manner as in Example 1, except that the coating liquid for a protective layer B-9 was used instead of the coating liquid for a protective layer B-1.

Example 10

A protective layer transfer sheet of the present invention was prepared in the same manner as in Example 1, except that the coating liquid for a protective layer B-12 was used instead of the coating liquid for a protective layer B-1.

Example 11

A protective layer transfer sheet of the present invention was prepared in the same manner as in Example 1, except that the coating liquid for a protective layer B-13 was used instead of the coating liquid for a protective layer B-1.

Comparative Example 1

A comparative protective layer transfer sheet was prepared in the same manner as in Example 1, except that the coating liquid for a protective layer A-2 and the coating liquid for a protective layer B-10 were used respectively instead of the coating liquid for a protective layer A-1 and the coating liquid for a protective layer B-1.

Comparative Example 2

A comparative protective layer transfer sheet was prepared in the same manner as in Example 1, except that only the coating liquid for a protective layer A-1 was used without using the coating liquid for a protective layer B-1 and the coverage of the coating liquid for a protective layer A-1 was 1.5 μm on a dry basis.

Comparative Example 3

A comparative protective layer transfer sheet was prepared in the same manner as in Example 1, except that only the coating liquid for a protective layer B-4 was used instead of the coating liquid for a protective layer A-1 and the coating liquid for a protective layer B-1 and the coverage of the coating liquid for a protective layer B-4 was 1.5 μm on a dry basis.

Comparative Example 4

A comparative protective layer transfer sheet was prepared in the same manner as in Example 1, except that the coating liquid for a protective layer A-3 and the coating liquid for a protective layer B-10 were used respectively instead of the coating liquid for a protective layer A-1 and the coating liquid for a protective layer B-1.

Comparative Example 5

A comparative protective layer transfer sheet was prepared in the same manner as in Example 1, except that a coating liquid for a protective layer B-11 was used instead of the coating liquid for a protective layer B-1.

Gradation images were then formed by thermal transfer recording as follows.

(Thermal Transfer Recording)

A transfer film UPC-740 for a sublimation dye transfer printer UP-D 70 A, manufactured by Sony Corp. was provided as a thermal transfer film, and the image-receiving paper 1 or the image-receiving paper 2 was provided as a thermal transfer image-receiving sheet. The thermal transfer film and the thermal transfer image-receiving sheet were put on top of each other so that the dye layer faced the dye-receptive surface. Thermal transfer recording was carried out by means of a thermal head under the following conditions from the backside of the thermal transfer film in the order of Y, M, and C. Thus, gradation images of gray were formed.

(Printing Conditions)

Thermal head: KGT-217-12 MPL 20, manufactured by Kyocera Corp.

Average resistance value of heating element: 3195Ω

Print density in scanning direction: 300 dpi

Print density in feed direction: 300 dpi

Applied power: 0.15 w/dot

One line period: 6 msec

Printing initiation temp.: 40° C.

Gradation control method: A multipulse-type test printer was used wherein the number of divided pulses with a pulse length obtained by equally dividing one line period into 256 parts is variable from 0 to 255 during one line period. In this case, the duty ratio for each divided pulse was fixed to 35%, and, according to the gradation, the number of pulses per line period was brought to 0 for step 0, 17 for step 1, 34 for step 2 and the like. In this way, the number of pulses was successively increased from 0 to 255 by 17 for each step. Thus, 16 gradation steps from step 0 to step 15 were controlled to form a gradation image.

Next, a protective layer was transferred onto the formed gradation image under the following conditions.

(Transfer of Protective Layer)

Each of protective layer transfer sheets prepared in the examples and the comparative examples was put on top of the print formed by the thermal transfer recording so that the protective layer surface faced the image-receiving surface. A protective layer was then transferred onto the whole area of the printed face by means of the thermal head under the same printing conditions as described above except that, in the gradation control, the number of pulses per line period was fixed to 210, that is, data for blotted image printing was used.

(Adhesion Test)

A blotted image of a magenta color was formed by means of a thermal head under the same printing conditions as described above except that, in the gradation control, the number of pulses per line period was fixed to 110, that is, data for blotted image printing was used. A protective layer was transferred onto the blotted image in such a manner that, according to the gradation, the number of pulses per line period was brought to 140 for step 1, 145 for step 2, 150 for step 3 and the like. In this way, the number of pulses was successively increased from 140 to 240 by 5 for each step. Thus, 21 gradation steps from step 140 to step 240 were controlled. In this case, the gradation value, at which the transfer of the protective layer began to transfer, was determined.

(Evaluation Criteria)

Gradation value: The smaller the numerical value, the better the adhesion.

X: The transfer of protective layer did not occur even when the gradation value (number of pulses per line period) was 240.

(Plasticizer Resistance Test)

Arutoron (a vinyl chloride sheet) manufactured by Mitsubishi Chemical Corporation was provided. This sheet was put on top of the image face of the print, and the assembly was allowed to stand under a load of 0.78 N/cm$^2$ in a storage environment of 50° C. and dry for 50 hr.

(Evaluation Criteria)

◎: Neither failure of image nor coloration of vinyl chloride sheet occurred, that is, the plasticizer resistance was good.

○: No failure of image occurred, and coloration of vinyl chloride sheet somewhat occurred, that is, the plasticizer resistance was substantially good.

X: Breaking of image occurred, that is, the plasticizer resistance was poor.

(Lightfastness Test)

The prints with a protective layer being transferred were tested for lightfastness with a xenon fadeometer under the following conditions.

Irradiation tester: Ci 35, manufactured by Atlas

Light source: Xenon lamp

Filter: Inner side=IR filter, outer side=soda-lime glass

Black panel temp.: 45° C.

Irradiation intensity: 1.2 W/m$^2$ . . . value as measured at 420 nm

Irradiation energy: 400 kJ/m$^2$ . . . integrated value at 420 nm

Hue change level: The optical reflection density of Bk in gray images was measured with an optical densitometer (Macbeth RD-918, manufactured by Macbeth). For the step at which the optical reflection density before the irradiation was around 1.0, $L^*a^*b^*$ before and after the irradiation was measured with a colorimeter/color difference meter (CR-321, manufactured by Minolta Camera Co., Ltd.), and the hue change level was calculated according to the following equation to evaluate the lightfastness of the prints.

$$\text{Hue change level}=((a^{*1}-a^{*2})^2+(b^{*1}-b^{*2})^2)^{0.5}$$

$L^*a^*b^*$ value before irradiation: $L^{*1}$, $a^{*1}$, $b^{*1}$ $L^*a^*b^*$ value after irradiation: $L^{*2}$, $a^{*2}$, $b^{*2}$ (Alcohol Resistance Test)

A swab was impregnated with water or ethanol, and the swab was then reciprocated five times on the image to rub surface of the image with the swab.

(Evaluation Criteria)

○: Rubbing did not cause any trace, that is, the alcohol resistance was good.

X: Rubbing caused traces, that is, the alcohol resistance was poor.

The evaluation results were as summarized in Table 2 below.

TABLE 2

| | Adhesion | | Plasticizer resistance | | Lightfastness | | | | |
|---|---|---|---|---|---|---|---|---|---|
| | Image-receiving paper 1 | Image-receiving paper 2 | Image-receiving paper 1 | Image-receiving paper 2 | Image-receiving paper 1 | Image-receiving paper 2 | Fastness to water/alcohol Water | Fastness to water/alcohol Alcohol | Overall evaluation |
| Ex. 1 | 170 | 200 | ◎ | ○ | 20.5 | 13.1 | ○ | ○ | ○ |
| Ex. 2 | 170 | 195 | ◎ | ◎ | 23.3 | 14.8 | ○ | ○ | ○ |

TABLE 2-continued

| | Adhesion | | Plasticizer resistance | | Lightfastness | | | | |
|---|---|---|---|---|---|---|---|---|---|
| | Image-receiving paper 1 | Image-receiving paper 2 | Image-receiving paper 1 | Image-receiving paper 2 | Image-receiving paper 1 | Image-receiving paper 2 | Fastness to water/alcohol Water | Fastness to water/alcohol Alcohol | Overall evaluation |
| Ex. 3 | 160 | 150 | ◎ | ◎ | 25.7 | 15.0 | ○ | ○ | ○ |
| Ex. 4 | 170 | 190 | ◎ | ○ | 18.5 | 12.2 | ○ | ○ | ○ |
| Ex. 5 | 170 | 150 | ◎ | ◎ | 10.3 | 6.0 | ○ | ○ | ◎ |
| Ex. 6 | 170 | 190 | ◎ | ◎ | 7.8 | 5.5 | ○ | ○ | ◎ |
| Ex. 7 | 180 | 170 | ◎ | ◎ | 11.8 | 5.8 | ○ | ○ | ◎ |
| Ex. 8 | 175 | 175 | ◎ | ◎ | 9.7 | 6.0 | ○ | ○ | ◎ |
| Ex. 9 | 170 | 170 | ◎ | ◎ | 7.3 | 5.5 | ○ | ○ | ◎ |
| Ex. 10 | 160 | 150 | ◎ | ◎ | 8.0 | 6.0 | ○ | ○ | ◎ |
| Ex. 11 | 160 | 150 | ◎ | ◎ | 7.7 | 6.2 | ○ | ○ | ◎ |
| Comp. Ex. 1 | 200 | 170 | ○ | × | 11.9 | 6.2 | ○ | ○ | × |
| Comp. Ex. 2 | 200 | 170 | ○ | × | 10.0 | 6.0 | ○ | ○ | × |
| Comp. Ex. 3 | 170 | 190 | × | × | 8.3 | 6.8 | × | × | ×× |
| Comp. Ex. 4 | 200 | 170 | ◎ | ◎ | 11.8 | 6.8 | × | × | × |
| Comp. Ex. 5 | 175 | 180 | ○ | × | 9.6 | 6.2 | ○ | ○ | × |

As described above, according to the present invention, the protective layer transfer sheet comprises: a substrate sheet; and a thermally transferable protective layer provided on at least a part of one side of the substrate sheet, the protective layer being formed of a laminate having a multilayer structure comprising at least a layer composed mainly of an acrylic resin and a layer composed mainly of a polyester resin provided in that order on the substrate sheet. By virtue of this construction, excellent weathering resistance is imparted to a protective layer. When a protective layer has been transferred from the protective layer transfer sheet having the above construction onto an image, the transferred protective layer can prevent the dye from being transferred or fused onto vinyl chloride cases or the like, can prevent breakage of the image caused by the transfer of the dye, and can prevent a dye constituting the image from being faded upon exposure to light. Further, even when an alcohol or water is spilled on prints, no trace is left, that is, the transferred protective layer can impart excellent fastness properties to prints.

What is claimed is:

1. A protective layer(s) transfer sheet comprising: a substrate sheet; and thermally transferable protective layer(s) provided on at least a part of one side of the substrate sheet, said protective layer(s) being formed of a laminate having a multilayer structure comprising at least a layer composed mainly of an acrylic resin and a layer composed mainly of a polyester resin provided in that order on the substrate sheet, wherein the polyester resin comprises an alicyclic compound contained in at least one of a diol component and an acid component, and/or has, in one molecular chain, one or more aromatic dicarboxylic acids containing a sulfonic acid substituent or a group of a salt thereof.

2. The protective layer(s) transfer sheet according to claim 1, wherein the acrylic resin is an acrylic copolymer composed mainly of polymethyl methacrylate.

3. The protective layer(s) transfer sheet according to claim 1, wherein the alicyclic compound in the polyester resin is tricyclodecanemethanol, cyclohexanedicarboxylic acid, cyclohexanedimethanol, or cyclohexanediol.

4. The protective layer(s) transfer sheet according to claim 1, which further comprises a release layer between the protective layer(s) and the substrate sheet.

5. The protective layer(s) transfer sheet according to claim 1, which further comprises an adhesive layer stacked on the protective layer(s).

6. The protective layer(s) transfer sheet according to claim 1, wherein the layer composed mainly of the polyester resin and/or the adhesive layer contains an ultraviolet absorber.

7. The protective layer(s) transfer sheet according to claim 1, wherein an organic filler and/or an inorganic filler is/are contained in an outermost surface layer provided on the substrate sheet in its side remote from the protective layer(s).

8. A print comprising: a substrate sheet; at least a dye-colored image provided on at least one side of the substrate sheet; and a protective layer(s) provided so as to cover at least a part of the printed face in the print, said protective layer(s) having been formed by transfer using the protective layer(s) transfer sheet according to claim 1.

* * * * *